US011317649B2

(12) United States Patent
John et al.

(10) Patent No.: US 11,317,649 B2
(45) Date of Patent: May 3, 2022

(54) MATERIAL FOR INCLUSION IN A SMOKING ARTICLE

(71) Applicant: British American Tobacco (Investments) Limited, London (GB)

(72) Inventors: Edward John, London (GB); Jocelyn Benning, London (GB); Steven Coburn, London (GB); Thomas Brice, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 118 days.

(21) Appl. No.: 15/542,198

(22) PCT Filed: Jan. 5, 2016

(86) PCT No.: PCT/GB2016/050012
§ 371 (c)(1),
(2) Date: Jul. 7, 2017

(87) PCT Pub. No.: WO2016/110688
PCT Pub. Date: Jul. 14, 2016

(65) Prior Publication Data

US 2018/0020717 A1 Jan. 25, 2018

(30) Foreign Application Priority Data

Jan. 7, 2015 (GB) ..... 1500168

(51) Int. Cl.
*A24B 15/18* (2006.01)
*A24B 15/30* (2006.01)

(52) U.S. Cl.
CPC ..... *A24B 15/186* (2013.01); *A24B 15/303* (2013.01)

(58) Field of Classification Search
None
See application file for complete search history.

(56) References Cited

U.S. PATENT DOCUMENTS

| | | | |
|---|---|---|---|
| 46,233 | A | 2/1865 | Hale |
| 2,928,400 | A | 6/1954 | Touey |
| 3,046,995 | A | 5/1960 | Christy |
| 3,011,921 | A | 12/1961 | Specht |
| 3,885,575 | A | 5/1975 | Parker |
| 3,924,642 | A | 12/1975 | Eicher |

(Continued)

FOREIGN PATENT DOCUMENTS

| | | | |
|---|---|---|---|
| CA | 1225900 | A | 8/1987 |
| CN | 101065027 | A | 10/2007 |

(Continued)

OTHER PUBLICATIONS

International Preliminary Report on Patentability for corresponding application PCT/GB2016/050012 filed Jan. 5, 2016; dated Jan. 2, 2017.

(Continued)

*Primary Examiner* — Michael J Felton
*Assistant Examiner* — Katherine A Will
(74) *Attorney, Agent, or Firm* — Cantor Colburn LLP

(57) ABSTRACT

A smokeable material for inclusion in a smoking article, comprising tobacco coated with acacia gum, wherein the amount of acacia gum is at least 10% by weight of the tobacco.

21 Claims, 3 Drawing Sheets

(56) References Cited

U.S. PATENT DOCUMENTS

| | | | | |
|---|---|---|---|---|
| 4,175,996 | A | 11/1979 | Battard | |
| 4,253,473 | A | 3/1981 | Marmo | |
| 4,407,863 | A | 10/1983 | Yui | |
| 4,534,983 | A | 8/1985 | Koene | |
| 5,103,843 | A | 4/1992 | Burger | |
| 6,325,859 | B1 | 12/2001 | De Roos | |
| 2003/0029466 | A1 | 2/2003 | Oliver | |
| 2004/0003890 | A1 | 1/2004 | Bauer | |
| 2004/0094171 | A1 | 5/2004 | Wanna | |
| 2005/0000531 | A1 | 1/2005 | Shi | |
| 2005/0244521 | A1 | 11/2005 | Strickland | |
| 2006/0090769 | A1 | 5/2006 | Woodson | |
| 2007/0246054 | A1 | 10/2007 | Gedevanishvili | |
| 2007/0267033 | A1 | 11/2007 | Mishra | |
| 2009/0014018 | A1* | 1/2009 | Sengupta | A23F 3/14 131/276 |
| 2009/0030504 | A1 | 12/2009 | Worthen | |
| 2011/0036367 | A1 | 2/2011 | Saito | |
| 2011/0232657 | A1 | 9/2011 | Karles | |
| 2012/0160253 | A1 | 6/2012 | Coleman | |
| 2012/0298123 | A1 | 11/2012 | Woodcock | |

FOREIGN PATENT DOCUMENTS

| | | | |
|---|---|---|---|
| DE | 2262829 | A1 | 7/1974 |
| EP | 0150077 | A2 | 7/1985 |
| GB | 933161 | | 8/1963 |
| GB | 1171043 | | 11/1969 |
| GB | 1284151 | | 8/1972 |
| GB | 1349537 | | 4/1974 |
| GB | 1512352 | | 6/1978 |
| RU | 2010124193 | A | 12/2011 |
| WO | 2006014995 | A2 | 2/2006 |
| WO | 2011116975 | A1 | 9/2011 |
| WO | 2015004483 | A1 | 7/2014 |

OTHER PUBLICATIONS

International Search Report for corresponding application PCT/GB2016/050012 filed Jan. 5, 2016; dated Mar. 21, 2016.

Written Opinion for International Searching Authority for corresponding application PCT/GB2016/050012 filed Jan. 5, 2016; dated Mar. 21, 2016.

Leffingwell, John C., "Chemical Constituents of Tobacco Leaf and Differences Among Tobacco Types", Feb. 2001, Science Direct Working Paper No. S1574-0331(04)70433-6 (Abstract).

* cited by examiner

| | Cigarette Weight (g) | Circumference (mm) | Firmness (%) |
|---|---|---|---|
| Control (Water Treatment) | 0.84 | 24.6 | 78.2 |
| AG L1 | 0.82 | 24.7 | 74.9 |
| AG L2 | 0.85 | 24.7 | 78.0 |

Figure 3

| | NNN [ng/cig] | NAT [ng/cig] | NAB [ng/cig] | NNK [ng/cig] | NFDPM (mg/cig) | Nicotine (mg/cig) | Water [mg/cig] | CO [mg/cig] |
|---|---|---|---|---|---|---|---|---|
| Control (Water Treatment) | 150.9 | 153.3 | 23.8 | 76.3 | 23.8 | 1.96 | 10.4 | 20.3 |
| AG L1 | 117.5 | 111.2 | 17.6 | 59.0 | 23.1 | 1.96 | 10.7 | 19.3 |
| AG L2 | 119.9 | 105.9 | 16.4 | 56.8 | 20.5 | 1.63 | 9.0 | 17.0 |

Figure 4

| | NNN | NAT | NAB | NNK | NFDPM | Nicotine | Water | CO |
|---|---|---|---|---|---|---|---|---|
| AG L1 | -22% | -27% | -26% | -23% | -3% | 0% | 3% | -5% |
| AG L2 | -21% | -31% | -31% | -26% | -14% | -17% | -13% | -16% |

MATERIAL FOR INCLUSION IN A SMOKING ARTICLE

TECHNICAL FIELD

The invention relates to a smokeable material for inclusion in a smoking article, the material comprising tobacco coated with acacia gum.

BACKGROUND

Acacia gum is used in combustible products for purposes such as encapsulation of flavourants or diluents, use as a binder, or to form coatings on paper such as the wrapper of a smoking article.

SUMMARY

In accordance with a first aspect there is provided a smokeable material for inclusion in a smoking article, comprising tobacco coated with acacia gum, wherein the amount of acacia gum is at least 10% by weight of the tobacco.

In some embodiments, the amount of acacia gum is at least 20% by weight of the tobacco.

In some embodiments the smokeable material further comprises one or more of: tobacco substitutes, filler materials or uncoated tobacco. The one or more of the tobacco substitutes and filler materials may be coated with acacia gum, wherein the weight of acacia gum is at least 10% by weight of the material to be coated.

In some embodiments the coating substantially comprises or consists of acacia gum. In alternative embodiments, the coating further comprises one or more of diluents, humectants, flavours or flavourants, and aerosol generating means.

In some embodiments the smokeable material comprises less than 25% reconstituted tobacco and/or less than 10% tobacco dust.

In some embodiments the tobacco coated with acacia gum comprises less than 20% reconstituted tobacco and/or less than 10% tobacco dust.

According to a second aspect, there is provided a method of obtaining smokeable material which, when used as part of a smoking article, gives rise to a reduced level of one or more constituents of mainstream smoke, comprising applying a solution of acacia gum to the smokeable material and subsequently drying the smokeable material; wherein the smokeable material comprises tobacco, and wherein the solution comprises acacia gum in an amount of at least 10% by weight.

In some embodiments, the solution comprises acacia gum in an amount of at least 20% by weight.

In some embodiments, the solution further comprises one or more of diluents, humectants, flavours or flavourants, and aerosol generating means.

In some embodiments, the smokeable material to which the solution of acacia gum is applied comprises less than 25% reconstituted tobacco and/or less than 10% tobacco dust.

According to a third aspect there is provided a smoking article comprising smokeable material according to the first aspect. In some embodiments, the tobacco in the smoking article which is coated with acacia gum comprises at least 50% of one or more of lamina, stem and expanded tobaccos.

In a fourth aspect, there is provided the use of a solution of acacia gum to reduce the level of one or more constituents of mainstream smoke generated upon use of a smoking article.

BRIEF DESCRIPTION OF THE DRAWINGS

Embodiments of the invention will now be described, by way of example only, with reference to the accompanying drawings, in which:

FIG. 3 is a table showing the level of certain analytes as measured in the mainstream smoke resulting from cigarettes comprising tobacco coated with acacia gum, and control cigarettes comprising water treated tobacco.

FIG. 4 is a table showing the level of certain analytes as measured in the mainstream smoke resulting from cigarettes comprising tobacco coated with acacia gum, expressed as a percentage change compared to values generated by control cigarettes comprising water treated tobacco.

DETAILED DESCRIPTION

Figures 1, 2:
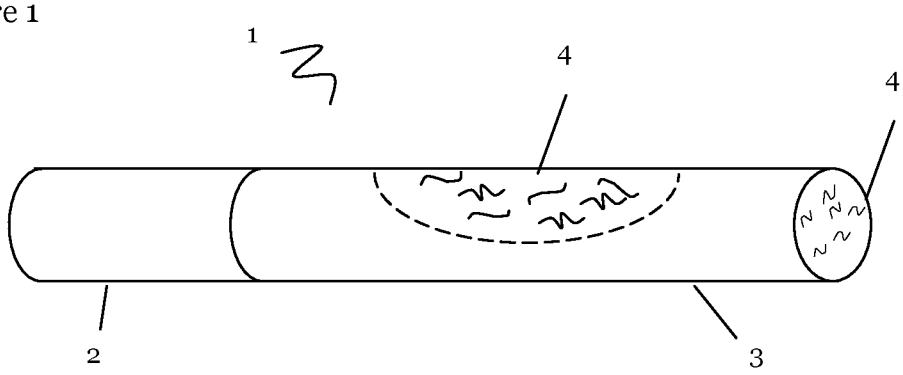
FIG. 1 is a representation of a smoking article in accordance with a third aspect of the present invention.
FIG. 2 is a table showing the results of quality testing module (QTM) physical analysis of test cigarettes comprising tobacco coated with acacia gum, and control cigarettes.

Smoke arising from a smoking article which comprises tobacco is a complex, dynamic mixture of more than 5000 identified constituents. The constituents are present in the mainstream smoke (MS), which exits the mouth end of the cigarette, and are also released between puffs as constituents of sidestream smoke (SS).

It can be a research objective to decrease levels of at least some of the constituents of mainstream smoke, such as one or more of aromatic amines; phenols; carbonyls; polycyclic aromatic hydrocarbons; acrylonitrile; volatile hydrocarbons such as toluene, isoprene, styrene and benzene; nitrogen heterocyclics such as pyridine; TSNAs such as N'-nitrosoanabasine (NAB), N'-nitrosoanatabine (NAT), 4-(methylnitrosamino)-1-(3-pyridyl)-1-butanone (NNK) and N'-nitrosonornicotine (NNN); and inorganic compounds such as ammonia, hydrogen cyanide, nitric oxide and carbon monoxide.

Methods for selectively reducing mainstream smoke and/or sidestream smoke constituents may include reducing the levels of certain compounds from the starting material by, for example, using biotechnological methods; blending of different types of tobacco, or treating the tobacco prior to incorporation into the smoking article; reducing the amount of tobacco in the smoking article by including diluents or fillers; ventilation of the smoking article, where ambient air is drawn into the smoking article to dilute the MS; and use of a filter, which enhances the removal of MS constituents. In addition, attempts have been made to selectively remove or reduce constituents from cigarette smoke by incorporating sorbents into the smoking article.

Acacia gum, which is also known as gum Arabic, meska or chaar gund, is made of the sap taken from two species of acacia tree (Acacia seyal and Acacia senegal). Its main component is arabin, which is the calcium salt of the polysaccharide arabic acid.

Acacia gum has a variety of uses. It is frequently included in soft drink syrups and confectionary in the food industry, and is used as a binder and/or emulsifying agent, suspending agent or viscosity increasing agent in certain pharmaceuticals and cosmetics.

Acacia gum has also been used in combustible products for purposes such as encapsulation of, for example, diluents;

as a vehicle for, for example, flavourants; use as a binder; and to form coatings on paper such as the wrapper of a smoking article.

It has now been discovered that providing a coating of acacia gum on tobacco for incorporation into a smoking article selectively decreases the level of one or more constituents in the mainstream smoke generated from such articles in use.

Furthermore, the observed reductions for several of these constituents were greater than expected by the reduction observed for nicotine, indicating that the reductions were a result of more than a simple dilution of the tobacco by acacia gum. In addition, the observed reductions for several of the constituents were greater than the reduction observed for nicotine-free dry particulate matter (NFDPM).

The term "NFDPM" is a term of the art, determined utilising a test methodology as would be understood by a skilled person. It is defined as the weight of mainstream smoke particulate matter trapped on a high efficiency particulate filter, minus the weight of nicotine and water on the filter. It is usually expressed in weight units of milligrams per cigarette.

Accordingly, in a first aspect there is provided a smokeable material for use in a smoking article, comprising tobacco coated with acacia gum, wherein the amount of acacia gum is at least 10% by weight of the tobacco.

In some embodiments, the amount of acacia gum is at least 15, 20, 25, 30, 35, 40, 45, 46, 47, 48, 49, 50, 55, 60 or 65% by weight of the tobacco.

In some embodiments, the tobacco coated with acacia gum is not overly brittle, thereby facilitating handling and processing.

In some embodiments, the smokeable material further comprises one or more of the components typically found in the tobacco rod of a combustible product such as a smoking article. For example tobacco lamina, tobacco stem, expanded tobacco, reconstituted tobacco, extruded tobacco, tobacco substitutes, and filler materials.

In some embodiments, the smokeable material further comprises uncoated tobacco.

In some embodiments, one or more of the further components of the smokeable material may be coated with acacia gum. In such embodiments, the amount of acacia gum may be at least 10% by weight of the material to be coated, and may be at least 15, 20, 25, 30, 35, 40, 45, 46, 47, 48, 49, 50, 55, 60 or 65% by weight of the material to be coated.

As used herein, the term "coated" refers to the presence of a non-particulate or substantially non-particulate covering on the surface of the tobacco and/or other component(s) of the smokeable material. In addition, the acacia gum may be absorbed into the leaf pores or other internal features of the tobacco and/or other component(s) of the smokeable material. In some embodiments the coating is a partial coating, in that it covers a percentage of the surface of the tobacco and/or other component(s) of the smokeable material. In alternative embodiments, the coating is a complete coating in that it covers all or substantially all of the surface of the tobacco and/or other component(s) of the smokeable material.

As used herein, the term 'non-particulate' means that the coating does not comprise solid or substantially solid material. For example, the coating does not comprise flecks or grains of material, but instead is a smooth covering over the surface of the tobacco and/or other component(s) of the smoking material.

In some embodiments the smokeable material comprises less than 10, 9, 8, 7, 6, 5, 4, 3, 2 or 1% tobacco dust. In certain embodiments, the smokeable material comprises substantially no tobacco dust.

In some embodiments the tobacco coated with acacia gum comprises less than 10, 9, 8, 7, 6, 5, 4, 3, 2, 1 or 0.5% tobacco dust. In certain embodiments, the tobacco coated with acacia gum comprises substantially no tobacco dust.

In some embodiments the smokeable material comprises less than 25% reconstituted tobacco, or less than 20, 16, 15, 12, 10, 9, 8, 7, 6, 5, 4, 3, 2, or 1% reconstituted tobacco. In some embodiments the smokeable material comprises substantially no or no reconstituted tobacco.

In some embodiments the tobacco coated with acacia gum comprises less than 20% reconstituted tobacco, or less than 19, 18, 17, 16, 15, 14, 13, 12, 11, 10, 9, 8, 7, 6, 5, 4.5, 4, 3.5, 3, 2.5, 2, 1.5, 1 or 0.5% reconstituted tobacco. In some embodiments the tobacco comprises substantially no or no reconstituted tobacco.

In some embodiments, the coating substantially comprises or consists of acacia gum.

In alternative embodiments, the coating further comprises one or more of diluents, humectants, flavours or flavourants, and aerosol generating means.

As used herein, the term 'diluent' means a material which can be used to dilute the smokeable material. Examples include glycerol, solanesol, neophytadiene, 3-methylanisole, eugenol, 1-phenyl-1-pentanone, 2,3-dimethyl-4-ethylacetophenone, nicotinic acid, docosane, dotriacontane, eicosane, neophytadiene, heneicosane, hentriacontane, heptacosane, hexacosane, nonacosane, octacosane, pentacosane, pentatriacontane, squalene, tetracosane, tetratriacontane, triacetin, triacontane, triacosane and tritriacontane.

As used herein, the term 'aerosol generating material' means a substance which, when incorporated into a smoking article rapidly creates or promotes an aerosol upon ignition of the article. Examples include polyhydric alcohols such as glycerol, propylene glycol and triethylene glycol; triethyl citrate, triacetin, or high boiling point hydrocarbons.

In some instances, the terms 'diluent' and 'aerosol generating material' can be used interchangeably. For example, some substances/materials have the effect of both diluting the smokeable material, and rapidly creating or promoting an aerosol upon incorporation into and ignition of a smoking article. Examples of such materials are triacetin and glycerol.

As used herein, the terms 'flavour' and 'flavourant' refer to materials which, where local regulations permit, may be used to create a desired taste or aroma in a product for adult consumers. Examples of flavours or flavourants include menthol, citrus, vanilla, aniseed, benzaldehyde or acetyladehyde.

According to a second aspect, there is provided a method of obtaining smokeable material which, when used as part of a smoking article gives rise to a reduced level of one or more constituents of mainstream smoke, comprising applying a solution of acacia gum to the smokeable material and subsequently drying the smokeable material; wherein the smokeable material comprises tobacco, and wherein the solution comprises acacia gum in an amount of at least 10% by weight.

In some embodiments, the solution comprises acacia gum in an amount of at least 15, 20, 25, 30, 35, 40, 45, 46, 47, 48, 49, 50, 55, 60 or 65% by weight.

The term "by weight" as used with reference to a method of obtaining smokeable material which, when used as part of a smoking article, gives rise to a reduced level of one or more constituents of mainstream smoke, means by weight of the smokeable material to which the solution is applied.

The solution of acacia gum comprises a suitable solvent, such as water, de-ionized or distilled water.

In some embodiments, the solution substantially comprises or consists of a solution of acacia gum. In alternative embodiments, the solution may comprise one or more further components such as one or more of diluents, humectants, flavours or flavourants, and aerosol generating means.

In some embodiments, the tobacco to which the solution is applied comprises at least 50, 55, 60, 65, 70, 75, 80, 82, 84, 85, 90, 95 or 100% of one or more of lamina, stem and expanded tobaccos. In some embodiments, the tobacco to which the solution is applied comprises at least 50, 55, 60, 65, 70, 75, 80, 82, 84, 85, 90, 95 or 100% lamina tobacco.

The smokeable material may further comprise one or more of the components typically found in the tobacco rod of a combustible product such as a smoking article. For example expanded tobacco, reconstituted tobacco, extruded tobacco, tobacco substitutes and filler materials.

In some embodiments the smokeable material for use in the method comprises less than 25% reconstituted tobacco, or less than less than 20, 18, 16, 15, 14, 13, 12, 11, 10, 9, 8, 7, 6, 5, 4, 3, 2, 1 or 0.5% reconstituted tobacco. In some embodiments the smokeable material for use in the method comprises substantially no or no reconstituted tobacco.

In some embodiments the smokeable material for use in the method comprises less than 10, 9, 8, 7, 6, 5, 4, 3, 2, 1 or 0.5% tobacco dust. In certain embodiments, the smokeable material for use in the method comprises substantially no tobacco dust.

The solution of acacia gum may be applied to the smokeable material by any suitable method, such as immersing the smokeable material in the solution of acacia gum, or spraying the smokeable material with a solution of acacia gum. In some embodiments, the solution may be sprayed onto a falling curtain of cut or shredded smokeable material.

The wetted smokeable material may then be dried by any suitable method. For example, the wetted smokeable material may be dried in a drying cabinet or oven at around 45° C. and around 30% relative humidity for around 5 hours, followed by further drying at around 22° C. and around 30% relative humidity until all added water has evaporated.

The process of applying a solution of acacia gum to the smokeable material and subsequently drying the smokeable material may be carried out more than once, in order to provide the smokeable material with several coats of acacia gum.

The dried smokeable material may then be conditioned, for example by placing it in a conditioning cabinet at around 22° C. and around 60% relative humidity for an appropriate period until equilibrium is attained.

In some embodiments, reductions in mainstream smoke constituents may include, but are not be restricted to, one or more of those substances known as Hoffmann analytes.

The term 'Hoffmann analytes' is a term of art. It relates to a group of constituents of mainstream smoke generated from a smoking article, and includes aromatic amines; phenols; carbonyls; polycyclic aromatic hydrocarbons; acrylonitrile; volatile hydrocarbons such as toluene, isoprene, styrene and benzene; nitrogen heterocyclics such as pyridine; and TSNAs such as nitrosoanabasine (NAB), nitrosoanatabine (NAT) and 4-(methylnitrosamino)-1-(3-pyridyl)-1-butanone (NNK) and N-Nitrosonornicotine (NNN); and inorganic compounds such as ammonia, hydrogen cyanide, nitric oxide and carbon monoxide.

Smokeable material comprising acacia gum may be incorporated into a smoking article, such as a cigarette. Accordingly, in a third aspect, there is provided a smoking article comprising smokeable material according to the first aspect.

Smoking articles according to the third aspect may further comprise one or more of uncoated tobacco, tobacco substitutes, filler material, diluents, binders, humectants, flavour or flavourants or aerosol generating material. These components may be mixed with tobacco and/or other components of smokeable material coated with acacia gum prior to incorporation into the smoking article.

In some embodiments the smoking article comprises less than 25% reconstituted tobacco, or less than 20, 18, 16, 15, 14, 13, 12, 11, 10, 9, 8, 7, 6, 5, 4, 3, 2, 1 or 0.5% reconstituted tobacco. In some embodiments the smoking article comprises substantially no or no reconstituted tobacco.

In some embodiments, the smoking article comprises less than 10, 9, 8, 7, 6, 5, 4, 3, 2, 1 or 0.5% tobacco dust. In certain embodiments, the smoking article does not comprise tobacco dust.

In some embodiments the tobacco in the smoking article coated with acacia gum comprises at least 50, 55, 60, 65, 70, 75, 80, 82, 84, 85, 90, 95 or 100% of one or more of lamina, stem and expanded tobaccos. In some embodiments, the tobacco in the smoking article coated with acacia gum comprises at least 50, 55, 60, 65, 70, 75, 80, 82, 84, 85, 90, 95 or 100% lamina tobacco.

In some embodiments the tobacco in the smoking article, whether coated with acacia gum or uncoated comprises at least 50, 55, 60, 65, 70, 75, 80, 82, 84, 85, 90, 95 or 100% of one or more of lamina, stem or expanded tobaccos. In some embodiments the tobacco in the smoking article, whether coated with acacia gum or uncoated comprises at least 50, 55, 60, 65, 70, 75, 80, 82, 84, 85, 90, 95 or 100% lamina tobacco.

Smoking articles according to the present invention may conform to any size or dimensions known for smoking articles.

Alternatively, smoking articles according to the invention may comprise a coaxial core, comprising an inner core and outer annulus of smokeable materials, and wherein smokeable material according to the first aspect may be incorporated into either or both of the inner core or outer annulus. In such embodiments, the smoking article may comprise the same or different wrapper materials for the inner core and outer annulus.

Smoking articles typically comprise a filter at the mouth end, a rod which comprises smokeable material, and paper wrapped around the rod.

Smoking articles according to the third aspect may comprise any filter configuration known in the art. Filters for smoking articles typically comprise one or more of fibrous cellulose acetate, polypropylene material, polyethylene material, or gathered paper material.

Referring to FIG. 1, a smoking article 1 is illustrated comprising a filter 2 and a substantially cylindrical tobacco rod 3, aligned with the filter 2, such that one end of the tobacco rod 3, abuts the end of the filter. The tobacco rod 3, has a cut away area to demonstrate the location of tobacco coated with acacia gum 4. The tobacco rod 3 is joined to the filter 2 by tipping paper in a conventional manner.

According to a fourth aspect, there is provided the use of a solution of acacia gum to reduce the level of one or more constituents of mainstream smoke generated upon use of a smoking article.

In some embodiments, reductions in mainstream smoke constituents may include, but are not restricted to, one or more of those substances known as Hoffmann analytes.

Without wishing to be bound by any theory, it is suggested that the effects resulting from incorporation of acacia gum into a smoking article arise from a change in the combustion and/or pyrolysis profile of the components of the smokeable material. This may be as a result of the physical presence of the acacia gum, which exerts physicochemical effects on thermal processes within the combustion and/or pyrolysis zones, resulting in reductions of analytes.

The observation that the reductions were greater than expected by reduction of NFDPM for many of the substances in mainstream smoke may indicate that synergistic effects could be occurring within the complex, dynamic combustion and/or pyrolysis processes occurring within the smoking article. In addition, the observation that the reductions in TSNAs were greater than the reduction of nicotine indicates that the reductions in TSNAs are a result of more than simple dilution of the tobacco by acacia gum, and that, whilst not wishing to be bound by any theory, mechanisms may be occurring during the combustion process in the cigarettes comprising acacia gum which result in enhanced reductions of some analytes compared with control cigarettes comprising water treated tobacco.

The following examples are provided to illustrate the present invention and should not be construed as limiting thereof.

Example 1

Solutions of acacia gum were prepared using de-ionized water as set out in Table A, below. The resultant solutions had a viscosity which was sufficient to allow handling and distribution across the material being coated, and formation of an even coating on the smokeable material. In addition, the resultant tobacco was relatively easy to handle, remained free-flowing, and was not overly brittle.

Acacia gum coated tobacco was prepared. 300 g of US style blend tobacco was placed in a sample bag. A solution of acacia gum was added.

Control tobacco was also prepared, wherein 300 g of the same blend tobacco was contained in a sample bag and water (only) was added to the bag. This tobacco is referred to as 'Control Water Treatment'.

Details relating to the acacia gum coated tobacco and the control tobacco are summarized in Table A, below.

TABLE A

| Sample | Tobacco (g) | Water (mL) | Acacia gum (g) |
|---|---|---|---|
| Control Water Treatment | 300 | 300 | 0 g |
| Acacia Gum Level 1 (AG L1) | 300 | 300 | 30 g |
| Acacia Gum Level 2 (AG L2) | 300 | 300 | 60 g |

The Control Water Treatment sample and acacia gum-treated tobacco were then dried. Drying was carried out using a drying cabinet set to 45° C. and 30% relative humidity for 5 hours, followed by further drying at 22° C. and 30% relative humidity for approximately 12 hours (Control Water Treatment sample and AG $L_1$) or over an extended period (approximately 48 hours; AG $L_2$).

The Control Water Treatment sample and acacia-gum treated tobacco were then conditioned at 22° C. and 60% relative humidity.

Tray weights were recorded periodically throughout both the drying and conditioning stages. For the drying stage the tray weights were used to calculate the amount of added water that had been removed. For the conditioning stage, tray weights were used to calculate when the tobacco was in equilibrium with the conditions i.e. no weight gain/loss. After 7 days of conditioning, once the tray weights were stable, readings were taken using a halogen moisture analyser.

Cigarettes were then made from the Control Water Treatment sample and acacia gum-coated tobacco (AG $L_1$ and AG $L_2$). In each case the tobacco was inserted into pre-made cigarette rods using a Marshall McGearty Cigarette Maker ("mini maker"). The mini maker is a non-automated process used in small scale cigarette production.

Tobacco is placed into the hopper, and compressed by a suitable weight. A portion is then segregated in a compression chamber and formed into a cylindrical rod and introduced into a cigarette spill, through the filling nozzle, using a lever. Five spills can be filled at one time. The weights on the tobacco can be varied and affects the amount of tobacco entering the segregation chamber and hence the spill. This in turn affects the firmness value of the cigarette which is measured using a quality testing module.

To correct for weight variability, 40 cigarettes were individually weighed for each sample and statistically analysed to calculate the interquartile range. Cigarettes were selected from this range for smoke analysis.

A quality testing module physical analysis of cigarettes comprising tobacco coated with acacia gum, and control cigarettes was carried out. Results are shown in FIG. 2.

The cigarettes were then smoked using the smoking regime detailed in Table B, below.

TABLE B

| | |
|---|---|
| Puff Volume (mL) | 55 |
| Puff Duration (s) | 2 |
| Puff Frequency (s) | 30 |
| Ventilation | Closed |

Five replicates were carried out, with five cigarettes smoked per replicate. The mainstream smoke from each cigarette was analysed, and the mean of all replicates was calculated.

Results

Figure 5:
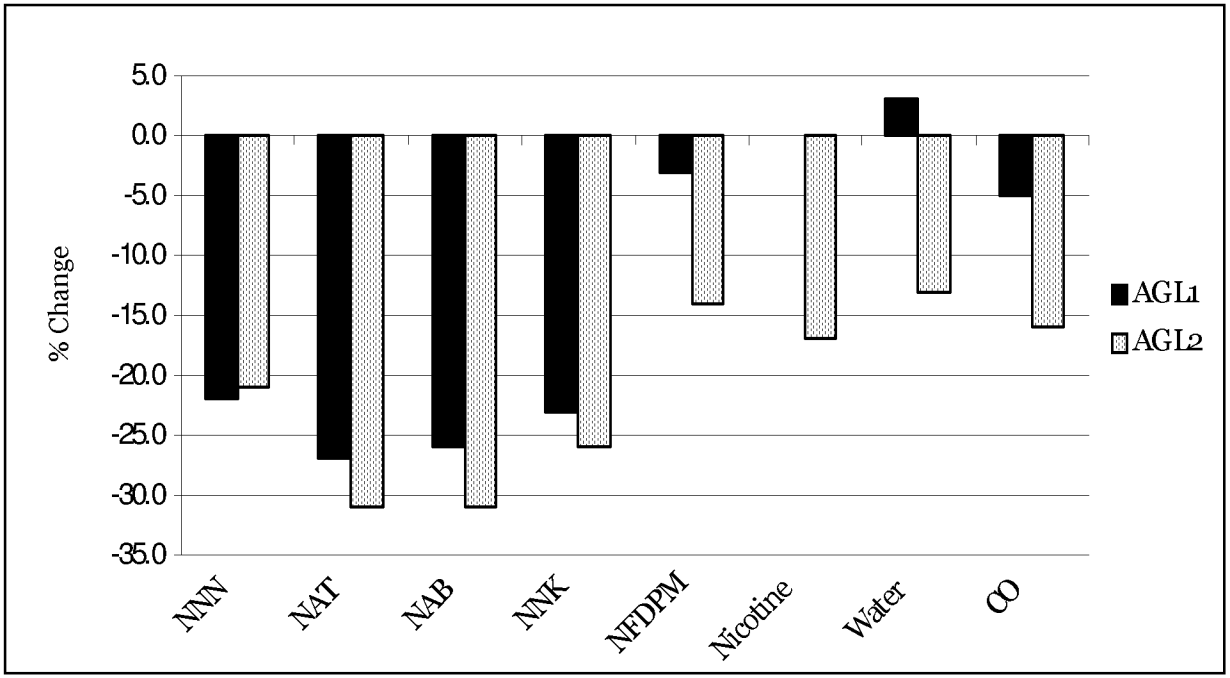
FIG. 5 is a graph of the data in FIG. 4.

Results were expressed as absolute values (FIG. 3); and as a percentage change compared to the Control Water Treatment (FIGS. 4 and 5).

FIG. 3 demonstrates that cigarettes comprising tobacco coated with both 10% (AG $L_1$) and 20% (AG $L_2$) acacia gum by weight of the tobacco had lower levels of NNN, NAT, NAB, and NNK and CO than the Control Water Treatment sample.

FIGS. 4 and 5 demonstrate that cigarettes comprising tobacco coated with 10% (AG $L_1$) acacia gum by weight of the tobacco had reduced levels of NNN, NAT, NAB, NNK and CO in comparison to the Control Water Treatment sample; and cigarettes comprising tobacco coated with 20% (AG $L_2$) acacia gum by weight of the tobacco had reduced levels of NNN, NAT, NAB, NNK, nicotine, water and CO in comparison to the Control Water Treatment sample.

In addition, the levels of NNN, NAT, NAB, NNK, and CO were reduced in cigarettes containing both 10% (AG $L_1$) and 20% (AG $L_2$) acacia gum by weight of tobacco to a greater extent than the reduction observed for NFDPM.

Further to this, FIGS. 4 and 5 show that the reduction of NNN, NAT, NAB, and NNK for cigarettes containing both 10% (AG $L_1$) and 20% (AG $L_2$) acacia gum by weight of tobacco was greater than that observed for nicotine, indicating that the reductions in TSNAs are a result of more than a simple dilution of tobacco by the addition of acacia gum.

Without wishing to be bound by any theory, it is suggested that, since nicotine levels were either not reduced (AG $L_1$, 10% acacia gum by weight of tobacco) or reduced to a lesser extent compared with the TSNAs (AG $L_2$, 20% acacia gum by weight of tobacco), mechanisms may be occurring during the combustion process in the cigarettes comprising acacia gum which result in enhanced reductions of TSNAs compared with control cigarettes comprising water treated tobacco.

In order to address various issues and advance the art, the entirety of this disclosure shows, by way of illustration, various embodiments in which the claimed invention may be practiced and provide for a superior process for preparing material for inclusion in a smoking article comprising tobacco coated with acacia gum, wherein the amount of acacia gum is at least 10% by weight of the tobacco. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. Smokeable material for inclusion in a smoking article, comprising tobacco coated with acacia gum, wherein the amount of acacia gum is at least 10% by weight of the tobacco, wherein the tobacco coated with acacia gum comprises at least 50% of one or more of lamina, stem and expanded tobaccos, and the acacia gum covers substantially all of a surface of at least one of the lamina, stem, and expanded tobaccos; and wherein the smokeable material comprises less than 10% tobacco dust.

2. Smokeable material as claimed in claim 1, wherein the amount of acacia gum is at least 20% by weight of the tobacco.

3. Smokeable material as claimed in claim 2, comprising less than 25% reconstituted tobacco; and/or less than 10% tobacco dust.

4. A method of obtaining smokeable material according to claim 2, comprising applying a solution of acacia gum to the smokeable material and subsequently drying the smokeable material; wherein the smokeable material comprises tobacco, and wherein the solution comprises acacia gum in an amount of at least 10% by weight.

5. Smokeable material as claimed in claim 1, further comprising one or more of tobacco substitutes, filler materials or uncoated tobacco.

6. Smokeable material as claimed in claim 5, wherein one or more of the tobacco substitutes and filler materials are coated with acacia gum, wherein the weight of acacia gum is at least 10% by weight of the material to be coated.

7. Smokeable material as claimed in claim 1, wherein the coating consists of acacia gum.

8. A method of obtaining smokeable material according to claim 7, comprising applying a solution of acacia gum to the smokeable material and subsequently drying the smokeable material; wherein the smokeable material comprises tobacco, and wherein the solution comprises acacia gum in an amount of at least 10% by weight.

9. Smokeable material as claimed in claim 1, wherein the coating further comprises one or more of diluents, humectants, flavours or flavourants, and aerosol generating means.

10. Smokeable material as claimed in claim 1, comprising less than 25% reconstituted tobacco.

11. Smokeable material as claimed in claim 1, wherein the tobacco coated with acacia gum comprises less than 20% reconstituted tobacco and/or less than 10% tobacco dust.

12. A method of obtaining smokeable material according to claim 11, comprising applying a solution of acacia gum to the smokeable material and subsequently drying the smokeable material; wherein the smokeable material comprises tobacco, and wherein the solution comprises acacia gum in an amount of at least 10% by weight.

13. A method of obtaining smokeable material according to claim 1, comprising applying a solution of acacia gum to the smokeable material and subsequently drying the smokeable material; wherein the smokeable material comprises tobacco, and wherein the solution comprises acacia gum in an amount of at least 10% by weight.

14. A method according to claim 13, wherein the solution comprises acacia gum in an amount of at least 20% by weight.

15. A method according to claim 13, wherein the solution further comprises one or more of diluents, humectants, flavours or flavourants, and aerosol generating means.

16. A method according to claim 13, wherein the smokeable material to which the solution of acacia gum is applied comprises less than 25% reconstituted tobacco; and/or less than 10% tobacco dust.

17. Method according to claim 13, wherein the solution of acacia gum is configured to reduce the level of one or more constituents of mainstream smoke generated upon use of a smoking article.

18. A smoking article comprising smokeable material according to claim 1.

19. A smoking article as claimed in claim 18, wherein the tobacco in the smoking article coated with acacia gum comprises at least 50% of one or more of lamina, stem and expanded tobaccos.

20. Smokeable material as claimed in claim 1, wherein the coating consists of acacia gum.

21. Smokeable material as claimed in claim 1, comprising substantially no tobacco dust.

* * * * *